US006913784B2

(12) United States Patent
Xue et al.

(10) Patent No.: US 6,913,784 B2
(45) Date of Patent: Jul. 5, 2005

(54) CONTINUOUS PROCESS FOR IMPREGNATING SOLID ADSORBENT PARTICLES INTO SHAPED MICRO-CAVITY FIBERS AND FIBER FILTERS

(75) Inventors: Lixin Luke Xue, Midlothian, VA (US); Kent B. Koller, Chesterfield, VA (US); Qiong Gao, Great Neck, NY (US); Tim Sherwood, Midlothian, VA (US); Charles E. Thomas, Richmond, VA (US); George R. Scott, Midlothian, VA (US); Liqun Yu, Midlothian, VA (US)

(73) Assignee: Philip Morris USA Inc., New York, NY (US)

( * ) Notice: Subject to any disclaimer, the term of this patent is extended or adjusted under 35 U.S.C. 154(b) by 166 days.

(21) Appl. No.: 10/294,346

(22) Filed: Nov. 14, 2002

(65) Prior Publication Data

US 2003/0168070 A1 Sep. 11, 2003

Related U.S. Application Data

(60) Provisional application No. 60/334,296, filed on Nov. 30, 2001.

(51) Int. Cl.[7] ..... B05D 1/12; B05D 3/12

(52) U.S. Cl. ..... 427/180; 427/174; 427/346; 427/348; 427/369

(58) Field of Search ..... 427/459, 475, 427/482, 485, 174, 180, 177, 346, 348, 355, 359, 369, 242, 289, 293, 421, 427

(56) References Cited

U.S. PATENT DOCUMENTS

| | | | | |
|---|---|---|---|---|
| 3,595,137 | A | | 7/1971 | Molins et al. |
| 4,858,629 | A | | 8/1989 | Cundari |
| 5,057,368 | A | | 10/1991 | Largman et al. |
| 5,123,373 | A | * | 6/1992 | Iyer et al. |
| 5,244,614 | A | | 9/1993 | Hagen |
| 5,328,736 | A | * | 7/1994 | Charles et al. |
| 5,704,966 | A | | 1/1998 | Rohrbach et al. |
| 5,713,971 | A | | 2/1998 | Rohrbach et al. |
| 5,744,236 | A | | 4/1998 | Rohrbach et al. |
| 5,902,384 | A | | 5/1999 | Rohrbach et al. |
| 6,723,378 | B2 | * | 4/2004 | Hrubesh et al. |

* cited by examiner

*Primary Examiner*—Fred J. Parker
(74) *Attorney, Agent, or Firm*—Connolly Bove Lodge & Hutz LLP

(57) ABSTRACT

A process of impregnating fine adsorbent particles such as carbon dust or APS silica gel powder into the micro-cavities of shaped fibers comprises the steps of continuously conveying shaped fibers with micro-cavities to a reservoir of the fine adsorbent particles. The fibers pass through the reservoir to thereby produce relative motion between the fibers and the particles. Additionally, impact forces are created between the shaped fibers and the fine particles to assist in impregnating the particles into the micro-cavities of the fibers. Any excess particles are removed from the fibers outside the reservoir, and subsequently the shaped fibers impregnated with fine adsorbent particles are collected for later use in filter applications such as cigarette filter and air filter applications, for example.

14 Claims, 6 Drawing Sheets

Fig. 5A.
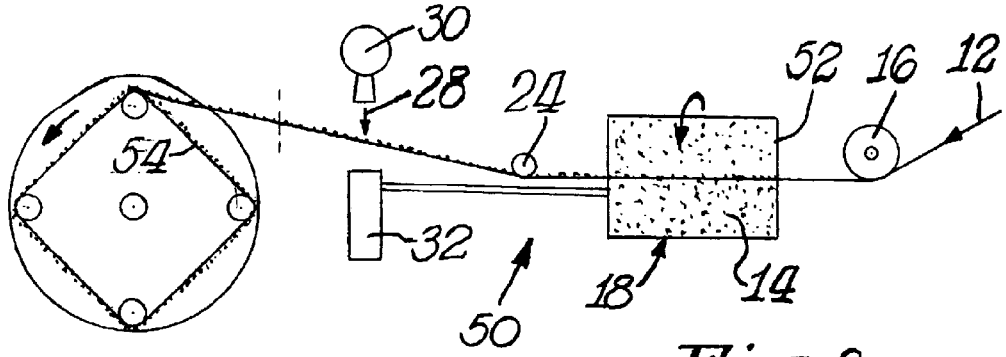
Fig. 5B.
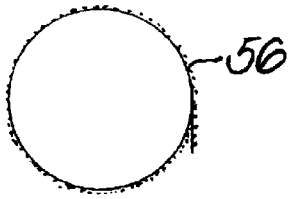
Fig. 8.
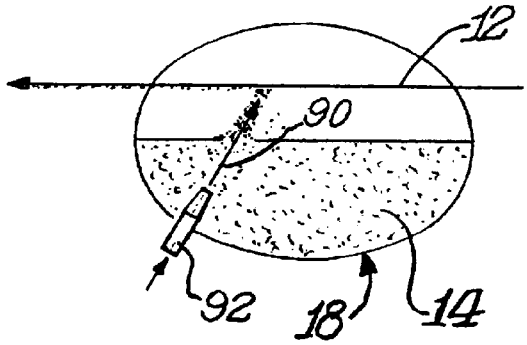
Fig. 5C.
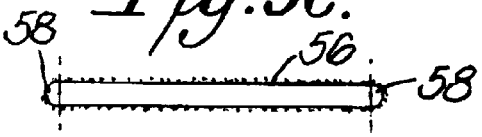
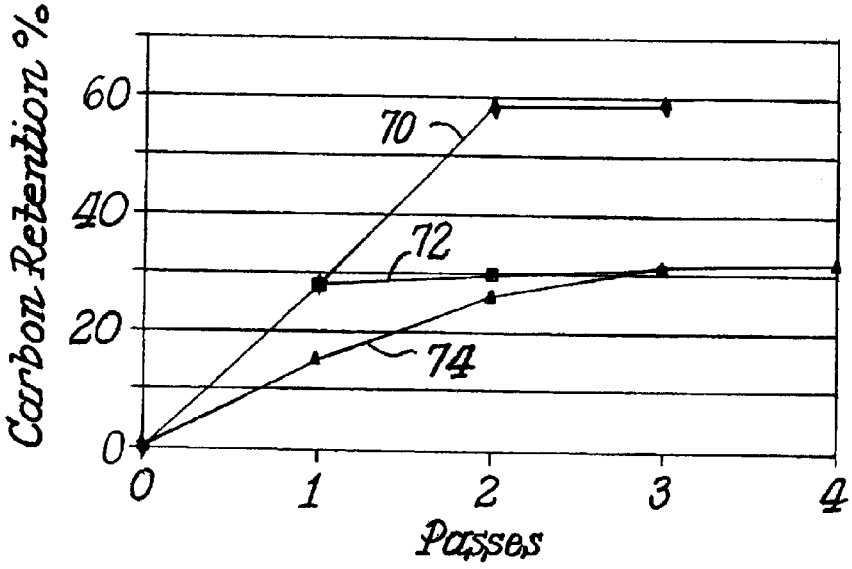
Fig. 9

CONTINUOUS PROCESS FOR IMPREGNATING SOLID ADSORBENT PARTICLES INTO SHAPED MICRO-CAVITY FIBERS AND FIBER FILTERS

CROSS-REFERENCE TO RELATED APPLICATION

The present application relates to provisional application Ser. No. 60/334,296, filed Nov. 30, 2001, a full priority benefits of that application are claimed. Moreover, the entire contents of this provisional application are included herein by reference.

BACKGROUND OF THE INVENTION

The present invention relates to a process for impregnating solid adsorbent particles into the micro-cavities of shaped fibers for subsequent use in filter applications such as for example cigarette filters that selectively remove or reduce certain components from mainstream tobacco smoke.

Over the years a wide variety of fibrous materials have been employed in tobacco smoke filter elements. Cellulose Acetate ("CA") has long been considered the material of choice for this application. However, the choice of materials has been limited because of the need to balance various commercial requirements. A very important property is the filtration efficiency i.e. the ability to selectively remove or reduce certain components from mainstream cigarette smoke stream.

To achieve appropriate filtration efficiency, materials such as carbon have been incorporated into cigarette filters. A current method for incorporating adsorbent materials in cigarette filters is the physical entrapment of adsorbent particles between CA fibers. The particle size of materials used is generally limited and in the range of 500 to about 1500 microns in diameter. In order to achieve reasonable product integrity and pressure drop, smaller particles could not be used in this design. In addition, the adsorbents were found to lose activity from exposure to triacetin, a plasticizer used as a binder for the CA fibers.

An improved and more expensive design is to put certain materials such as carbon in the cavity between CA plugs in a Plug/Space/Plug (P/S/P) filter configuration to limit the exposure of adsorbent to the binder. In order to keep the pressure drop through the filter within acceptable limits, coarse granulated materials in the size range of about 10 to about 60 mesh are generally used. A longer shelf life of the adsorbent is achieved, but the efficiency of the filters is limited by the relatively large particle size used. Finer size adsorbent particles with shorter internal diffusive paths and higher effective surface areas cannot be used directly in this configuration due to excessive pressure drop.

Smaller particle size adsorbent materials generally have enhanced kinetics of reaction with gas phase components because of their shorter diffusion paths to the interior surface area of such porous materials and the interior body of such adsorbent materials. It was known that employing smaller adsorbent particles with shorter diffusion paths can form filters with improved kinetics and capacity for gas phase filtration applications.

As explained in application Ser. No. 09/839,669, filed Apr. 20, 2001, and incorporated herein by reference in its entirety for all useful purposes, a fiber with open or semi-open micro-cavities is desirable for holding in place the adsorbent/adsorbent material such as carbon. The term "semi-open cavities" as used herein means cavities that possess openings smaller in dimension than the internal volume of the fiber in which they are formed, and that possess the ability to entrap solid fine particles in their internal volume. The term "open cavities" means the opening is the same or bigger in dimension than the internal volume of the fiber in which they are formed.

SUMMARY OF THE INVENTION

A primary object of the present invention is a continuous process for impregnating large quantities of shaped micro-cavity fibers with fine solid adsorbent particles such as carbon for subsequent filtration applications.

Another object of the present invention is a continuous process which is simple but highly efficient in impregnating shaped micro-cavity fibers with fine solid adsorbent particles such as carbon.

In accordance with the present invention, a continuous process produces large quantities of micro-cavity fibers impregnated with adsorbent fine particles such as carbon. The general concept of the process is to expose a continuous shaped fiber to a reservoir that contains particles suitable for impregnating into the micro-cavities on the fiber. With appropriate relative motion and impact forces between the fiber and the particles, the particles are loaded into the cavities of the fiber. The excess particles on the fiber surface may be removed by vibrating the fiber on a free drawing distance or by exposing the fiber to an impact gas flow. In the process, appropriate relative motion between the fiber and the particles within the reservoir may be created by any single or combination of processes including, but not limited to, stirring, vibrating, shaking, or blowing the particles inside the reservoir or by rotating the reservoir. Forces to facilitate the impregnation of particles into the cavities may come from relative motion and/or from fiber contact with surfaces of roller guides or bobbin(s) under tension. The gas stream to remove the excess particles may be an air stream from a pressured or vacuum source.

In accordance with the present invention, a process of impregnating fine adsorbent particles into the micro-cavities of shaped fibers comprises the steps of continuously conveying such shaped fibers to a reservoir of fine adsorbent particles such as carbon dust. The shaped fibers pass through the reservoir thereby producing relative motion between the fibers and the particles, and such relative motion causes the particles to impregnate the micro-cavities of the fibers. Additionally, impact forces are created between the shaped fibers and the fine adsorbent particles to further assist in impregnating the particles into the micro-cavities of the fibers. Excess particles are removed from the fibers outside the reservoir, and the shaped fibers impregnated with the fine adsorbent particles are subsequently collected for further use in cigarette filter applications.

Preferably the step of additionally creating impact forces between the shaped fibers and the fine adsorbent particles may include vibrating or rotating the reservoir, mechanically forcing the particles into the micro-cavities as the fibers pass through the reservoir or blowing the particles onto the shaped fibers as the fibers pass through the reservoir.

Preferably the step of removing excess particles from the fibers outside the reservoir includes applying an air stream onto the fibers generated from a pressurized or vacuum source. The excess particles so removed from the fibers are preferably recycled back to the reservoir. Moreover, the step of collecting the impregnated shaped fibers may include winding the fibers onto a winding wheel thereby producing a generally circular bundle of fibers. Such circular bundle of fibers may be flattened and the end portions of the flattened bundle cut away so that the remaining fibers are aligned with one another in a particularly useful form for cigarette filter applications.

The shaped fibers may be repeatedly passed through the reservoir to increase the impregnation of the micro-cavities. Also, it is preferred that the shaped fibers be drawn through the reservoir of fine adsorbent particles at a speed which provides a predetermined dwell time in the reservoir depending upon the dimensions of the reservoir.

Moreover, the fibers produced by the processes and apparatus of the present invention may be used in a variety of filter applications such as cigarette filters and air filters for continuous removal of odors and humidity. These fibers applications avoid the problems of reduced flow rates and reduced removal efficiency over time.

In addition to comprising micro-cavities which include fine adsorbent particles, the shaped fibers also preferably contain granules, more preferably carbon granules from 20 to 60 mesh. These shaped fibers may be incorporated into filters of cigarettes. Preferably, the granules are dispersed on the surface of the shaped fibers loaded with the fine adsorbent particulate. Alternatively, the granules may be adjacent one or both ends of the shaped fibers. Preferably, the particles are carbon dust, wherein most of the particles each have a diameter of from 15 to 35 microns. Alternatively, the particles are 3-aminopropyl-silanol-treated silica gel, wherein most of the particles each have a diameter of from 2 to 10 microns. In preferred embodiments, the cigarette filter comprises from 5 to 200 mg of particles, from 50 to 150 mg of particles, or from 90 to 110 mg of particles, and also comprises from 50 to 200 mg of shaped fiber, from 50 to 100 mg of shaped fiber, or from 100 to 150 mg of shaped fiber. Preferably, the cigarette comprises from 5 to 200 mg of granules, from 50 to 150 mg of granules, or from 90 to 110 mg of granules.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 5A is a schematic diagrammatic view illustrating impregnation of shaped fibers and collection of the carbon impregnated shaped fibers on a winding wheel, according to the present invention.

FIG. 5B shows a bundle of carbon impregnated shaped fibers removed from the winding wheel of FIG. 5A.

FIG. 5C shows the bundle of carbon impregnated shaped fiber removed from the winding wheel of FIG. 5A, flattened and about to be cut at the ends thereof along the cut lines shown in phantom outline;

FIG. 8 is a diagrammatic view illustrating a stream of fine carbon particles directed onto the micro-cavities of a shaped fiber, according to the present invention;

FIG. 9 is a graph of carbon retention percentage on a shaped fiber versus the number of passes of the shaped fiber through a carbon bed for different size carbon particles;

DETAILED DESCRIPTION OF THE INVENTION

Figure 1:
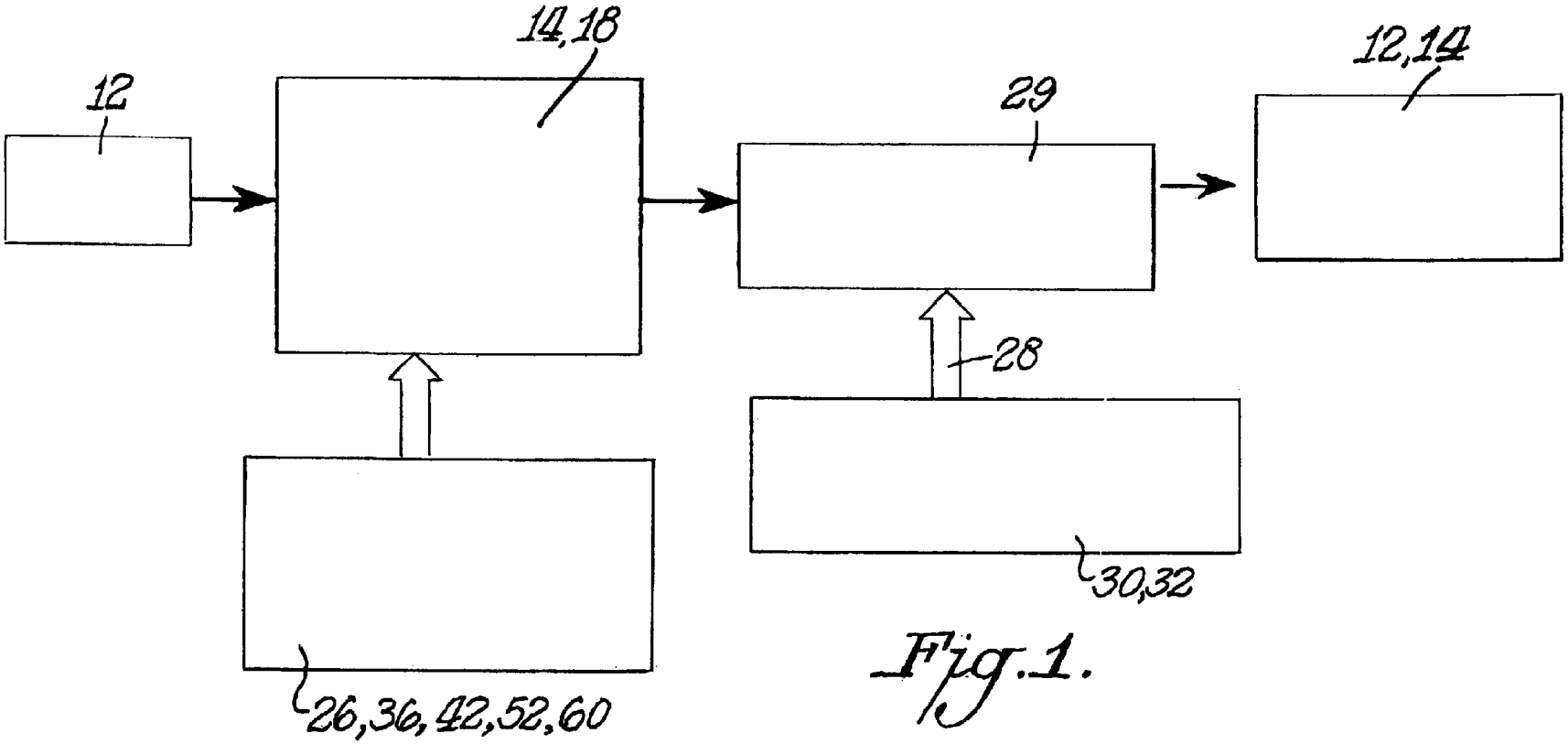
FIG. 1 is a flow diagram illustrating the process of the present invention.

Referring in more particularity to the drawings, FIG. 1 is a diagrammatic flow chart illustrating the general concept of the present invention. Starting at the left of FIG. 1 and moving to the right, a shaped fiber 12 is conveyed to a reservoir 18 of fine particles 14 such as carbon or APS silica gel powder, and the shaped fiber passes through the reservoir where the particles are impregnated into micro-cavities on the fiber. Some impregnation occurs as a result of the relative movement between the fiber and the fine particles within the reservoir. Additionally, a mechanical enhanced particle pick-up 26, 36, 42, 52, 60 is associated with the reservoir in order to enhance impregnation of the shaped fiber. As explained more fully below, such enhanced particle pick-up may be created by vibrating or rotating the reservoir or by mechanically forcing the particles into the micro-cavities or by blowing the particles into the cavities.

Upon exit of the fibers from the reservoir any excess particles may be removed at station 29 by directing an air stream 28 onto the fibers from a pressurized or vacuum source 30, 32. Mechanical vibration may also be used for this purpose. Ultimately, the fibers 12, 14 are collected and subsequently processed for use in filter applications including but not limited to cigarette and air filters.

Shaped fibers with micro-cavities are described in U.S. Pat. No. 5,057,368 which is incorporated by reference in its entirety for all useful purposes. This patent describes shaped micro-cavity fibers that are multilobal such as trilobal or quadrilobal. Other U.S. patents which describe shaped micro-cavity fibers include U.S. Pat. Nos. 5,902,384; 5,744,236; 5,704,966 and 5,713,971, each of which is incorporated by reference in its entirety including the drawings thereof. In addition, U.S. Pat. Nos. 5,244,614 and 4,858,629 specifically disclose multilobal fibers, and these patents are incorporated by reference in their entirety for all useful purposes.

Suitable fine particles 14 have a size in the range of about 1 to about 50 micrometers in diameter and include, but are not limited to, carbons, aluminas, silicates, molecular sieves, zeolites, and metal particles. The carbon powders used can be, but are not limited to, wood based, coal based or coconut shell based or derived from any other carbonaceous materiel. Optionally, the solid powder may be treated with desired chemical reagents, so as to modify the particle surfaces to include a particular functional group or functional structure. Coconut shell carbon powder available from Pica and a powdered amino propyl silyl (APS) silica gel powders are particular examples.

Figure 2:
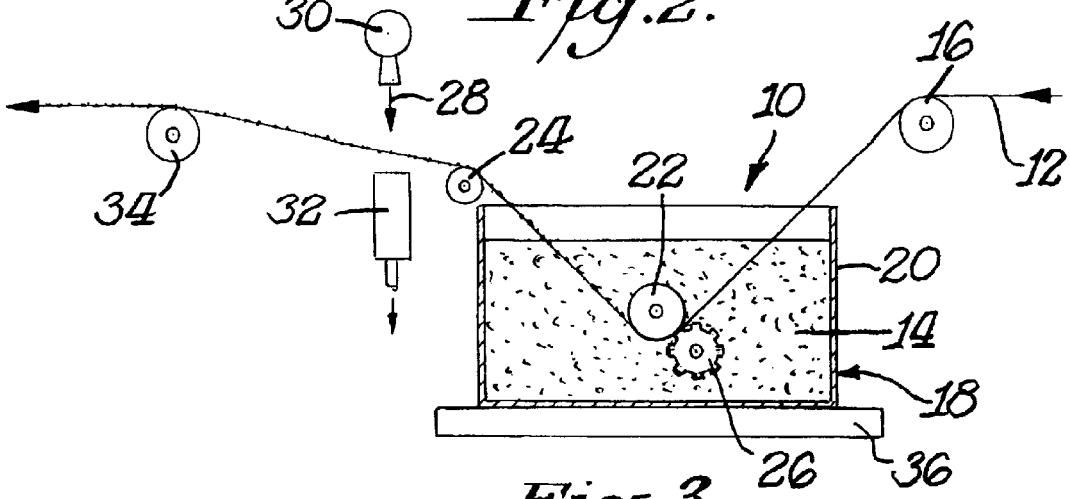
FIG. 2 is a schematic diagrammatic view illustrating a continuous process of impregnating fine solid particles into the micro-cavities of shaped fibers, according to the present invention.

FIG. 2 of the drawings shows a system 10 for impregnating shaped fibers 12 with fine particles such as carbon dust 14 in the range of 1 to 50 micrometers in diameter. The fiber 12 is conveyed over a guide 16 to a reservoir 18 in the form of a container 20. The container holds the carbon dust 14 as illustrated. The shaped fiber 12 passes through the reservoir of carbon dust where the carbon is impregnated into the micro-cavities of the shaped fiber 12 as a result of the relative motion between the fiber and the carbon dust. A roller 22 within the reservoir and an exit roller 24 guide the fiber 12 through the reservoir.

A compactor roller 26 is also positioned within the reservoir close to guide roller 22. This compactor roller functions to mechanically force carbon dust 14 into the micro-cavities of the shaped fiber. Compactor roller 26 basically functions to enhance the impregnation of the micro-cavities with carbon.

Upon exiting the reservoir, the fiber 12 impregnated with carbon is subjected to an air stream 28 from a pressurized source 30 in order to remove any excess carbon from the fiber. Alternatively or in combination with the pressurized source 30, air flow may be established by a vacuum source 32. Ultimately, the fiber 12 impregnated with carbon is transported over guide roller 34 for collection and further processing.

The container 20 of reservoir 18 may be subjected to vibration by a vibrating base pedestal 36 so as to maintain the carbon dust in a fluidized state. Such vibration enhances the impregnation of carbon into the micro-cavities of the shaped fiber 12. Preferably, the shaped fiber is drawn through the reservoir at a speed in the range of 5 to 15 meters per minute, preferably 10 meters per minute. However, the key factor is the amount of dwell time in the reservoir which maximizes impregnation. Once that dwell time is established for a particular reservoir, the speed is adjusted depending upon the dimensions of the reservoir to achieve the targeted dwell time.

Figure 3:
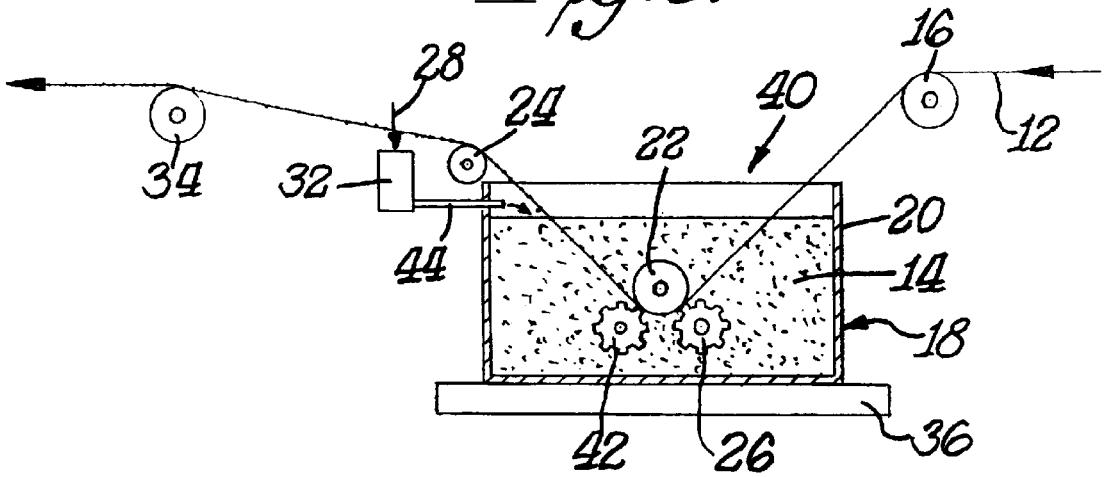
FIG. 3 is another schematic diagrammatic view illustrating an alternative continuous process of impregnating fine solid particles into the micro-cavities of shaped fibers, according to the present invention.

FIG. 3 shows another system 40 for impregnating the micro-cavities of shaped fibers with carbon dust 14. System 40 is similar to the system shown in FIG. 2, and similar reference characters are utilized to identify similar parts. The container 20 of reservoir 18 of system 40 includes a second compactor roller 42 close to guide roller 22 and this second compactor also functions to physically force carbon into the micro-cavities of the shaped fiber 12 as it passes through the reservoir. Another feature of system 40 is the recycling of any excess carbon dust removed from the shaped fiber outside the reservoir. In system 40, the vacuum source 32 creates the desired air flow, and the removed carbon dust is recycled back to the reservoir 18 via line 44.

Figure 4:
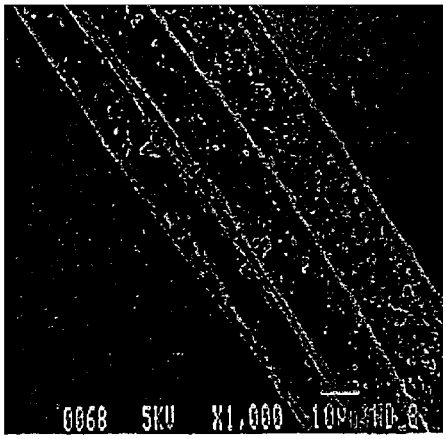
FIG. 4 is an actual microscopic photograph of a shaped fiber with the micro-cavities thereof impregnated with 1–10 micrometer carbon dust, according to the present invention.

FIG. 4 is an actual microscopic photograph of a shaped fiber 12 with the micro-cavities thereof impregnated with 1–10 micrometer carbon dust.

FIG. 5A shows another system 50 for impregnating shaped fibers 12 with fine particles such as carbon dust or APS silica gel powder, for example. Here again similar reference characters are used to identify those parts similar the systems shown in FIGS. 2 and 3. One major difference of the system 50 is the reservoir 18 of carbon dust 14 which is in the form of a rotating drum or canister 52. As the fiber passes through the rotating drum of carbon dust, relative movement of the shaped fiber and the drum causes impregnation of carbon into the micro-cavities of the shaped fiber. Additionally, the rotation of the drum maintains the carbon dust in a fluidized state thereby enhancing the impregnation process. Upon exiting the rotating drum 52, any excess carbon is removed from the fibers utilizing structural components similar to those described above. A tray 51 may be positioned directly below the fiber exiting the rotating drum to collect and recycle any excess carbon falling away from the fiber.

The shaped fibers impregnated with carbon may be directly transported to a plug maker (not shown) for producing cigarette filter plugs for attachment to tobacco rods in the manufacturing of cigarettes. Alternatively, as shown in FIG. 5A, the impregnated shaped fibers may be collected on a large winding wheel 54 driven by a suitable motor (not shown). This driven winding wheel also functions to draw the shaped fibers 12 through the reservoir 18. After collecting a number of turns of impregnated fibers on the winding wheel 54, the impregnated fibers are removed from the winding wheel in the form of a circular bundle of fibers 56 as shown in FIG. 5B. Controlling the number of turns of the winding wheel and/or the wheel diameter permits precise control of the size of the bundle and the number of fiber strands in the bundle. The circular bundle is subsequently flattened to the form diagrammatically shown in FIG. 5C, and the ends 58 of the flattened bundle are cut away thereby leaving a bundle of aligned impregnated fibers. These aligned fibers are then utilized in filter applications such as cigarette and air filters.

With respect to the embodiment of the invention shown in FIG. 5A, the rotating drum 54 may comprise a horizontally oriented canister constructed of stainless steel or other suitable durable material. The canister may have openings on each end as well as a threading guide on the inside thereof to assist in threading the shaped fiber through the canister. Moreover, the canister may also have an opening on the circumference thereof for loading of the fine particles. An agitator bar may be positioned inside the canister.

Figure 6:
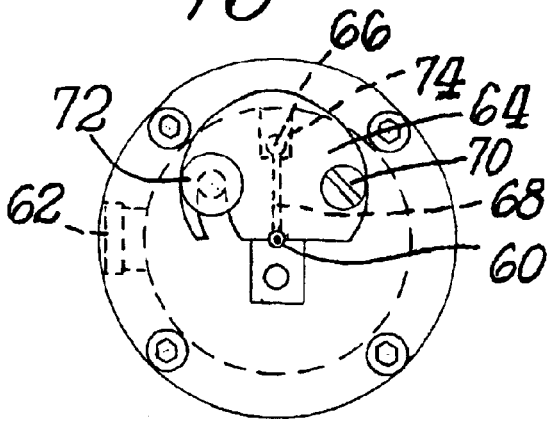
FIG. 6 is an end view of the carbon containing canister shown in FIG. 5A.

These features are shown in FIG. 6 which illustrates an end view of the carbon containing canister 54, the other canister end having a similar appearance. The fibers enter and exit the canister through a central opening 60, and a loading hatch 62 on the outside of the canister is used for loading of the fine particles. Each end of the canister includes a removable cover plate 64, and a threading guide is located behind the plate. The threading guide includes a large opening 66 in communication with the entrance/exit openings 60 by a thin shot 68. When threading fibers through the canister, the cover plates are rotated about pivot 70 to an open position, and the fibers are threaded through the comparatively large openings 66. The fibers are then slid through the slots 68 and into the entrance/exit openings 60. Ultimately the cover is rotated to its closed position and locked in place by tightening thumb screw 72. An agitator bar 74 is positioned inside the canister.

A jar mill of a variable speed may be used to rotate the canister. Moreover, the winding wheel 54 may be approximately 10 inches in diameter and turned by a variable gear motor at 0 to about 60 revolutions per minute.

Figure 7:
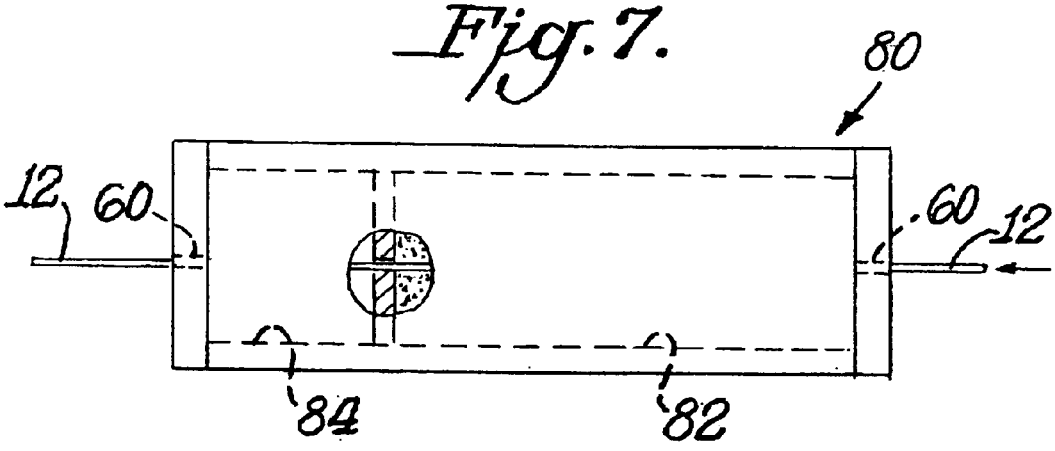
FIG. 7 is schematic diagrammatic view of an alternate embodiment of the carbon containing canister shown in FIG. 5A.

FIG. 7 shows a modified canister 80 including a primary compartment 82 containing the fine particles being deposited on the moving fibers and a secondary downstream compartment 84. In operation, the fibers are impregnated with fine particles as they travel through the rotating primary compartment. Any excess particle dust on the fibers is collected in the secondary compartment. Otherwise, canister 80 includes the same structural features described above in conjunction with drum/canister 54.

FIG. 8 diagrammatically illustrates another alternative of the present invention where an air stream 90 from a pressurized source 92 is utilized to blow carbon dust 14 onto the micro-cavities of shaped fiber 12. In this particular application, carbon dust is impregnated into the micro-cavities of the shaped fiber as a result of the relative motion between the shaped fiber 12 and the carbon dust within reservoir 18. Additionally, such impregnation is enhanced by the air stream 90 which blows the carbon dust onto the shaped fiber and into the micro-cavities thereof.

FIG. 9 is a plot of carbon retention weight percentage in the micro-cavities of the shaped fibers versus the number of fiber passes through the reservoir. Three curves 70, 72, 74 are illustrated for three different carbon particle sizes. In curve 70 the particle size is 1–10 micrometers, while in curve 72 the particle size is 8–15 micrometers and in curve 74 the particle size is 15–35 micrometers. Two fiber passes through the reservoir creates beneficial carbon retention weight percentages while after subsequent fiber passes the carbon retention percentage remains practically unchanged.

The following data in Table 1 is illustrious of carbon dust retention weight percentage on shaped fibers comprising 6 dpf (denier per filament) Triad® brand polypropylene fiber under varied drum rotation speeds.

TABLE 1

| | Carbon Retention Weight % (Weight % Loading of Carbon in the Fiber) | | | |
|---|---|---|---|---|
| RPM | Mixed Carbon % | + or − % | Carbon 15–35 um % | + or − % |
| 190 | 40 | 2 | 16 | 2 |
| 176 | 40 | 4 | 22 | 4 |
| 154 | 46 | 6 | 19 | 2 |
| 137 | 58 | 5 | 26 | 6 |
| 127 | 56 | 5 | 31 | 2 |
| 121 | 55 | 3 | 27 | 2 |

The carbon comprises fine carbon particles such as dust having a particle size of 15 to 35 microns while the mixed carbon comprises carbon having sizes 250 microns and below.

Figure 10:
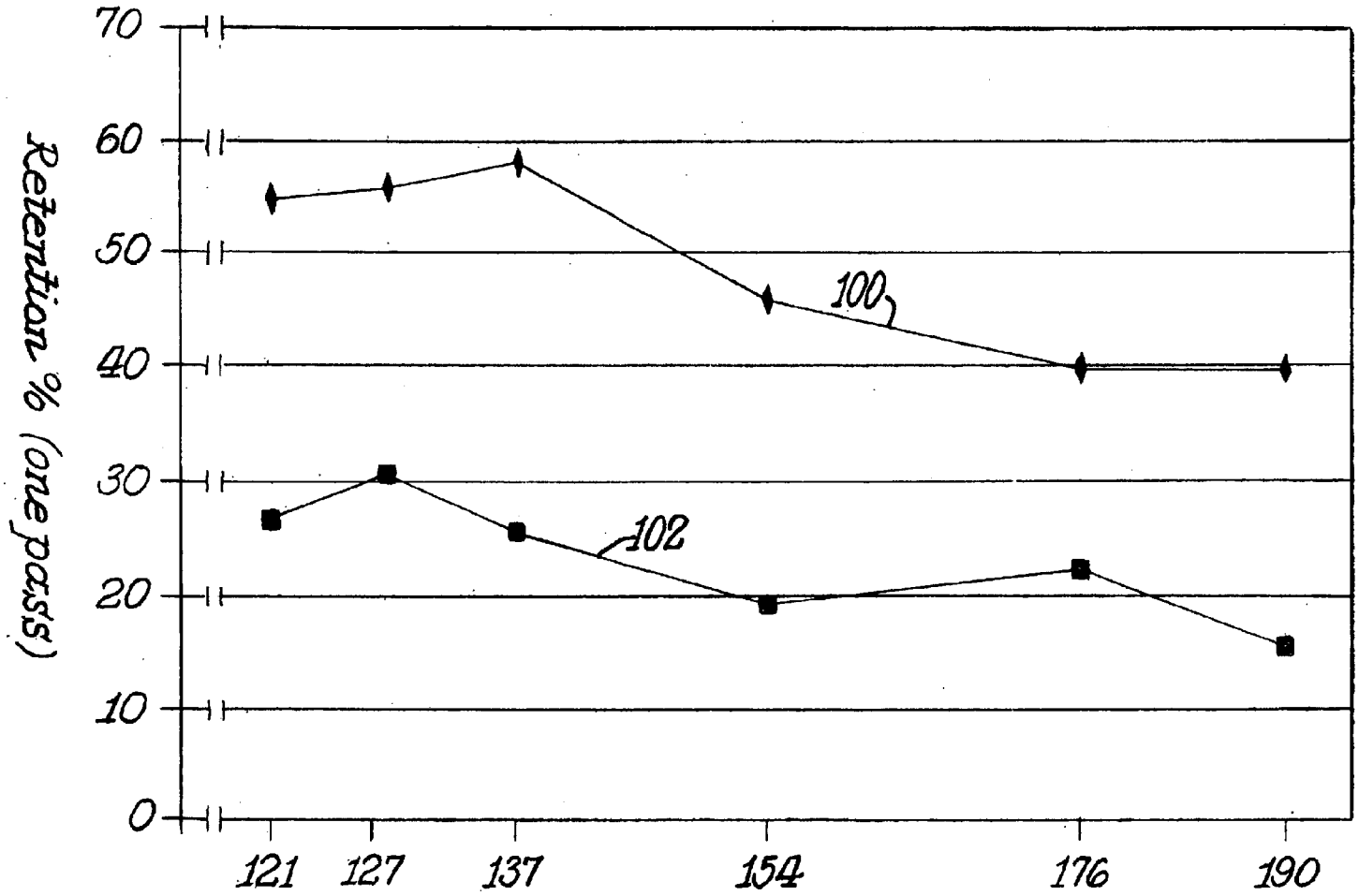
FIG. 10 is a graph of carbon retention percentage on a shaped fiber for one pass versus the rotary speed of a reservoir of fine adsorbent carbon particles.

FIG. 10 shows carbon retention weight percentages versus the rpm of rotating drum 52 for one pass through the drum. Curve 100 is for mixed carbon particles while curve 102 is for carbon having a particle size of 15–35 micrometers. The mixed carbon particles comprise PICA USA, Inc. #1705 having sizes 250 micrometers and below.

Preferably the rotating drum/canister is about 40 to 60 percent full of fine particles, most preferred about 50 percent. Also, the axis of ration may be slightly inclined, if desired. Moreover, as noted above the dwell time of the fiber within the reservoir of fine particles is a function of the speed and length of travel of the fiber through the reservoir. Once the length of travel is known, the speed is adjusted to provide the targeted dwell time for maximum impregnation. With a length of travel through the reservoir of about 20 cm, a residence time of at least 0.6 seconds has been most effective and additional residence time did not significantly increase the percent retention of fine particles on the fiber.

The following example shows several designs for cigarette filters using the shaped fibers of the present invention. This example is set forth by way of illustration only, and nothing therein shall be taken as a limitation upon the overall scope of the invention.

Figure 11:
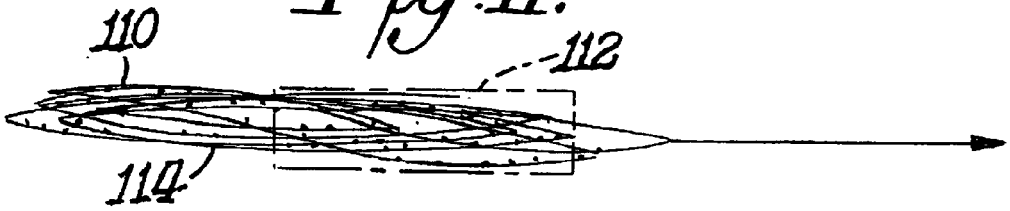
FIG. 11 is a diagrammatic view of a bundle of shaped fibers with adsorbent material in the open or semi-open fiber cavities and being formed into a cigarette filter.

FIG. 11 diagramatically illustrates a bundle of fibers 110 being formed into a cigarette filter by pulling the fibers into a cigarette filter tipping tube 112. The fibers include carbon particles 114 in the open or semi-open micro cavities thereof.

EXAMPLE

Figure 12A:
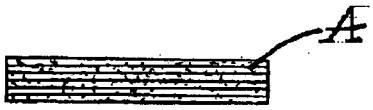
FIGS. 12A through D show various filter configurations.

FIGS. 12A, B, C and D illustrate four types of designs for cigarette filters using the shaped fibers of the present invention. In FIGS. 12A, B, C and D, each filter type is identified as A, B, C, and D, respectively. These filters are composed of parallel-arranged shaped fiber strands having open or semi-open micro-cavities with adsorbent in the cavities.

These shaped fiber strands retain high surface-area powdery adsorbent materials, e.g., carbon dust having particle diameters in the range of 1 to 50 microns. These fine particles are retained in the internal void volumes of the filaments in a configuration that does not obstruct gas flow. The light gas-phase components from the gas stream diffuse into the cavity and interact with the fine particles.

Figure 12B:
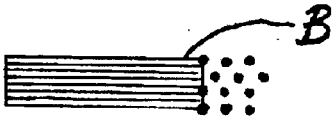
Figure 12C:
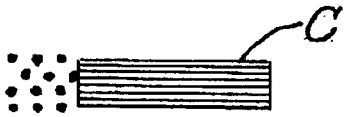
Figure 12D:
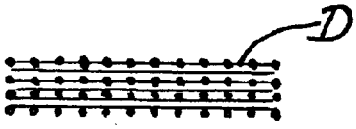

Types B, C, and D differ from filter in that the B, C, and D filters further include large granules of adsorbent. As shown in FIG. 12B, in the B filters, the large granules are incorporated in an upstream space, while in the C filters, the large granules are incorporated in a downstream space. In the D filters of FIG. 12D, the large granules are deposited between the shaped fiber filaments during the plug-making process. Consequently, these large granules are dispersed along the entire length of the filter. Filter plugs made of these filter types are used to form filters having rapid gas-adsorption kinetics, high capacity, and balanced selectivity for removing certain gas-phase components from a gas stream.

Figure 13:
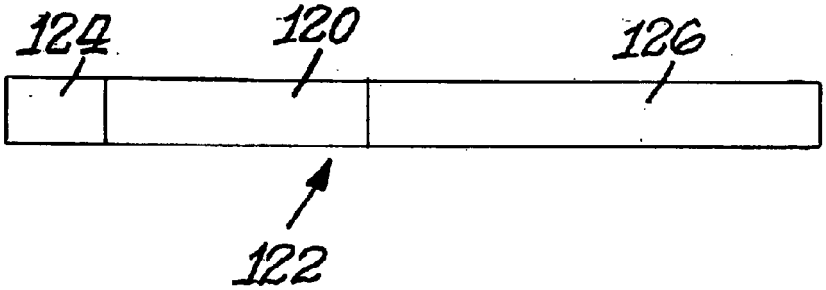
FIG. 13 is a side elevational view of a cigarette including a filter component and a tobacco rod.

Fabrication of Filters:

Types A1, A2, A3, A4, A5, A6, B3, B4, B5, B6, C3, and D3 filters were prepared. The A1 filters were made as follows. A 835.6 mg quantity of DPL-690 fiber (44 filaments bundle, 15.9 dpf PP-4DG® shape) from Fiber Innovation Technology was stretched by winding onto parallel poles fixed at a distance of 25 cm. After the ends of the formed fiber bundle were fixed by tightening ropes, the bundle was placed in a plastic bag and shaken completely with an excess amount of carbon dust (PUI No.1553, having particle diameters of 15 to 35 microns, from Pica). The fiber strand impregnated with the carbon dust was then separated from the mixture and pulled into a preformed cigarette filter tipping tube such as tube 112 of FIG. 11 having a diameter of 7.5 mm using the tightening ropes on the ends as guides. As shown in FIG. 11, this process allowed the fiber filaments to orient mostly parallel to gas flow. The fiber impregnated with carbon dust weighed 1162.8 mg (after removal of the tightening ropes and excluding the weight of the tipping tubes). The loading factor of per-fiber weight was 39.1%. The formed filter rod was then trimmed with a razor blade to give 20.5 mm-long plugs. The shaped-fiber weight and powder-loading weight for each individual filter plug were calculated using the total weight of the filter plug, the tipped paper weight, and the loading factor of the fiber. As shown in FIG. 13, each formed shaped fiber plug 120 was inserted into the hollow filter over wrap in a 1R4F reference cigarette 122 after removal of the CA filter plug. A CA filter plug 124 having a length of about 6.5 mm was then inserted into the downstream end of the cigarette. The reference cigarette 122 also includes a tobacco rod portion 126, as is well known.

The shaped filter plug used in the Type A filter also was used in the Types B, C, and D filters. Additionally, in Types B and C filters, carbon granules were introduced into the hollow 1R4F filter over wrap before or after the insertion of shaped fiber plugs. Additional CA plugs were used to complete the Types B and C filters. In Type D filters, carbon granules were dropped onto the shaped fiber strands as they were pulled into the filter tipping tubes. After trimming, the formed shaped fiber plugs contained the large granules trapped between the filaments.

The physical parameters for cigarette samples containing Types A1, A2, A3, B3, C3, and D3 filters are shown in Table 2, while the physical parameters for cigarette samples containing Types A4, A5, A6, B4, B5, and B6 filters are shown in Table 3.

TABLE 2

Cigarette Physical Parameters

| Cigarette Sample No. | Filter Type | Powder Type | Amount of Powder per Cigarette (mg) | Shaped Fiber Type | Amount of Shaped Fiber per Cigarette (mg) | Granule Type | Amount of Granule per Cigarette (mg) |
|---|---|---|---|---|---|---|---|
| 1 | A1 | 1553 | 40 | 16 dpf | 82 | none | 0 |
| 2 | A1 | 1553 | 37 | 16 dpf | 97 | none | 0 |
| 3 | A2 | APS | 72 | 16 dpf | 66 | none | 0 |
| 4 | A2 | APS | 77 | 16 dpf | 70 | none | 0 |
| 5 | A3 | 1553 | 91 | 24 dpf | 135 | none | 0 |
| 6 | A3 | 1553 | 88 | 24 dpf | 131 | none | 0 |
| 7 | B3 | 1553 | 95 | 24 dpf | 139 | G-277 | 5.4 |
| 8 | B3 | 1553 | 95 | 24 dpf | 132 | G-277 | 5.4 |
| 9 | C3 | 1553 | 94 | 24 dpf | 139 | G-277 | 6.9 |
| 10 | C3 | 1553 | 95 | 24 dpf | 142 | G-277 | 5.4 |
| 11 | D1 | 1553 | 36 | 16 dpf | 93 | G-277 | 22 |
| 12 | D1 | 1553 | 31 | 16 dpf | 80 | G-277 | 17 |
| 13 | D2 | 1553 | 58 | 16 dpf | 76 | G-277 | 76 |
| 14 | D2 | 1553 | 62 | 16 dpf | 82 | G-277 | 82 |
| 15 | D3 | 1553 | 90 | 24 dpf | 139 | G-277 | 139 |
| 16 | D3 | 1553 | 125 | 24 dpf | 133 | G-277 | 133 |

In the above Table 2, the powder type 1553 is a carbon dust 15 to 35 microns in diameter from Pica PUI No. 1533, while the APS powder type is 3-aminopropylsilanol-treated silica gel 2–10 microns in diameter from Grace Davison. The shaped fiber types 16 dpf PP-4DG® and 24 dpf PP-4DG® are from Fiber Innovation Technology, and the carbon granules are G-277 20 to 60 mesh carbon from Pica.

TABLE 3

Cigarette Physical Parameters

| Filter Type | Shaped Fiber Type | Amount of Shaped Fiber per Cigarette (mg) | Amount of 1553 powder per Cigarette (mg) | Amount of G-277 granules per cigarette (mg) |
|---|---|---|---|---|
| A4 | 48 dpf | 138 to 176 | 64 to 82 | 0 |
| A5 | 6 dpf | 133 to 211 | 45 to 75 | 0 |
| A6 | 16 dpf | 68 to 92 | 68 to 92 | 0 |
| B4 | 48 dpf | 94 to 111 | 94 to 111 | 24 to 35 |
| B5 | 6 dpf | 117 to 139 | 117 to 139 | 58 to 69 |
| B6 | 16 dpf | 62 to 88 | 62 to 88 | 69 to 78 |

For each filter type, batches of 30 cigarettes were prepared; each range given in the table encompasses the respective parameter for each cigarette in a batch. Also, the 48 dpf PP-Triad® shaped fiber and the 6 dpf PP-Triad® shaped fiber are from Honeywell, while the 16 dpf PP-4DG® shaped fiber is from Fiber Innovation Technology.

Sample Analysis:

Cigarette samples having Types A1, A2, A3, A4, A5, A6, B3, B4, B5, B6, C3, and D3 filters were smoked under well known FTC conditions, and puff-by-puff deliveries of gas-phase components were measured. Data for these samples are presented in Tables 4 through 8.

TABLE 4

Gas Phase Component Reduction

| Run | Filter Type | Puff Count | AA Reduction (%) | HCN Reduction (%) | MeOH Reduction (%) | ISOP Reduction (%) |
|---|---|---|---|---|---|---|
| 1 | A1 | 8 | 37 | 30 | 41 | 50 |
| 2 | A1 | 9 | 37 | 29 | 34 | 51 |
| 3 | A2 | 9 | 51 | 65 | 6 | 4 |
| 4 | A2 | 8.7 | 64 | 79 | 3 | 16 |
| 5 | A3 | 9 | 56 | 31 | 28 | 64 |
| 6 | A3 | 9 | 62 | 37 | 37 | 67 |
| 7 | B3 | 9 | 71 | 44 | 40 | 73 |
| 8 | B3 | 10 | 80 | 58 | 57 | 76 |
| 9 | C3 | 9 | 72 | 58 | 50 | 77 |
| 10 | C3 | 9.6 | 76 | 50 | 39 | 70 |
| 11 | D1 | 9 | 81 | 77 | 38 | 49 |
| 12 | D1 | 8.8 | 78 | 78 | 45 | 49 |
| 13 | D2 | 9 | 77 | 69 | 65 | 83 |
| 14 | D2 | 8 | 64 | 52 | 58 | 75 |
| 15 | D3 | 9 | 88 | 66 | 64 | 83 |
| 16 | D3 | 9 | 91 | 59 | 58 | 79 |

Runs were conducted using the cigarettes described in Table 3; each run number listed in Table 4 represents a run conducted using the cigarette of the same number listed in Table 2. Reduction data is presented for acetaldehyde (AA), hydrogen cyanide (HCN), methanol (MeOH) and isoprene (ISOP).

TABLE 5

Puff-By-Puff Delivery of Acetaldehyde

| | Filter Type | | | | | | | | |
|---|---|---|---|---|---|---|---|---|---|
| Puff | 1R4F (control) | A1 | A2 | A3 | B3 | C3 | D1 | D2 | D3 |
| 1 | 44 | 23 | 13 | 16 | 17 | 10 | 9 | 10 | 0 |
| 2 | 60 | 33 | 17 | 24 | 19 | 11 | 4 | 2 | 3 |
| 3 | 59 | 28 | 12 | 18 | 15 | 10 | 4 | 8 | 0 |
| 4 | 64 | 29 | 19 | 21 | 20 | 16 | 11 | 14 | 1 |
| 5 | 63 | 40 | 20 | 23 | 21 | 18 | 15 | 16 | 6 |
| 6 | 56 | 52 | 28 | 27 | 22 | 17 | 16 | 9 | 9 |
| 7 | 69 | 72 | 30 | 34 | 27 | 23 | 27 | 17 | 15 |
| 8 | 61 | 85 | 41 | 40 | 23 | 23 | 30 | 23 | 14 |
| 9 | 66 | 88 | 46 | 42 | 33 | 38 | 43 | 32 | 20 |

Each number in columns 2–10 refers to microgram quantity of acetaldehyde detected in the respective puff.

TABLE 6

Puff-By-Puff Delivery of Hydrogen Cyanide

| | Filter Type | | | | | | | | |
|---|---|---|---|---|---|---|---|---|---|
| Puff | 1R4F (control) | A1 | A2 | A3 | B3 | C3 | D1 | D2 | D3 |
| 1 | 6.5 | 3.6 | 1.2 | 3.4 | 2.7 | 1.7 | 1.1 | 0.4 | 0.7 |
| 2 | 5 | 3.7 | 0.8 | 3.1 | 3.4 | 2.3 | 1.3 | 1.0 | 1.0 |
| 3 | 6.3 | 4.1 | 0.7 | 4.7 | 5.1 | 2.4 | 1.7 | 2.2 | 1.3 |
| 4 | 7.7 | 5.3 | 1.3 | 6.5 | 6.4 | 3.3 | 2.9 | 2.5 | 1.9 |
| 5 | 9.7 | 7.0 | 2.3 | 6.6 | 6.9 | 3.7 | 3.7 | 3.3 | 2.6 |
| 6 | 10.8 | 9.6 | 3.5 | 7.6 | 8.1 | 4.7 | 4.4 | 2.7 | 4.2 |
| 7 | 13.8 | 12.5 | 3.4 | 9.0 | 8.2 | 6.3 | 5.0 | 3.3 | 5.0 |
| 8 | 13.1 | 15.2 | 4.7 | 10.3 | 8.1 | 7.0 | 6.1 | 4.2 | 6.0 |
| 9 | 13.6 | 17.8 | 3.0 | 10.6 | 10.1 | 7.2 | 6.8 | 4.5 | 7.2 |

Each number in columns 2–10 refers to microgram quantity of hydrogen cyanide detected in the respective puff.

TABLE 7

Puff-By-Puff Delivery of Methanol

| | Filter Type | | | | | | | | |
|---|---|---|---|---|---|---|---|---|---|
| Puff | 1R4F (control) | A1 | A2 | A3 | B3 | C3 | D1 | D2 | D3 |
| 1 | 5.9 | 3.1 | 3.3 | 3.4 | 3.0 | 1.8 | 3.1 | 4.5 | 2.0 |
| 2 | 5 | 3.1 | 2.8 | 3.7 | 3.3 | 2.8 | 2.4 | 2.9 | 1.4 |
| 3 | 5.2 | 2.3 | 4.7 | 4.0 | 4.1 | 2.4 | 1.9 | 2.5 | 2.2 |

TABLE 7-continued

| Puff-By-Puff Delivery of Methanol | | | | | | | | | |
|---|---|---|---|---|---|---|---|---|---|
| | Filter Type | | | | | | | | |
| Puff | 1R4F (control) | A1 | A2 | A3 | B3 | C3 | D1 | D2 | D3 |
| 4 | 6.2 | 4.4 | 6.2 | 4.5 | 5.5 | 3.2 | 1.6 | 3.7 | 2.1 |
| 5 | 8.1 | 4.9 | 8.3 | 5.6 | 5.5 | 4.2 | 3.1 | 5.0 | 2.6 |
| 6 | 9.4 | 6.8 | 11.5 | 7.0 | 7.3 | 4.8 | 3.6 | 7.4 | 3.6 |
| 7 | 11.1 | 10.4 | 15.2 | 8.1 | 8.5 | 6.5 | 5.3 | 8.6 | 4.6 |
| 8 | 13.7 | 15.2 | 20.6 | 11.2 | 12.0 | 8.6 | 7.2 | 11.3 | 5.3 |
| 9 | 16.1 | 22.9 | 20.8 | 13.7 | 13.2 | 10.7 | 9.5 | 18.2 | 7.7 |

Each number in columns 2–10 refers to microgram quantity of methanol detected in the respective puff.

TABLE 8

| Puff-By-Puff Delivery of Isoprene | | | | | | | | | |
|---|---|---|---|---|---|---|---|---|---|
| | Filter Type | | | | | | | | |
| Puff | 1R4F (control) | A1 | A2 | A3 | B3 | C3 | D1 | D2 | D3 |
| 1 | 25 | 9 | 23 | 11 | 8 | 6 | 7 | 12 | 4 |
| 2 | 38 | 8 | 43 | 15 | 9 | 6 | 6 | 15 | 5 |
| 3 | 35 | 7 | 33 | 9 | 7 | 5 | 6 | 17 | 2 |
| 4 | 31 | 11 | 30 | 10 | 9 | 6 | 6 | 19 | 2 |
| 5 | 27 | 14 | 38 | 12 | 9 | 10 | 6 | 20 | 5 |
| 6 | 27 | 21 | 42 | 15 | 13 | 8 | 7 | 23 | 7 |
| 7 | 44 | 33 | 43 | 18 | 17 | 12 | 8 | 23 | 8 |
| 8 | 40 | 46 | 42 | 18 | 19 | 14 | 12 | 32 | 10 |
| 9 | 43 | 66 | 29 | 22 | 21 | 17 | 15 | 48 | 12 |

Each number in columns 2–10 refers to microgram quantity of isoprene detected in the respective puff.

Cigarette samples having Types A4, A5, A6, B4, B5, and B6 filters were smoked under PM AMA method M-3-A where the whole smoke from cigarettes smoked under FTC conditions is bubbled through a liquid trap where smoke constituents containing a carbonyl group react with a reagent present in the trap. The liquid trap solution is subsequently analyzed by liquid chromatography for the presence of carbonyl compounds to determine the levels of carbonyl compounds (see Table 9 for results). The samples were also smoked under PM AMA method M-7-A where the whole smoke from cigarettes smoked under FTC conditions is bubbled through a chilled liquid trap containing methonal that solubilizes the volatile organic compounds in smoke. An aliquot of this liquid trap solution is injected into a Gas Chromatograph/Mass Spectroscopy analysis system where the individual compounds are identified and quantitated to determine the levels of volatile organic compounds (see Table 10 for results). The values in Tables 4 through 10 were calculated as follows. Each of the analytical methods used to determine the levels of the reported smoke constituents relies on a means of selectively responding to specific chemicals, e.g., infrared absorption at specific frequencies, chemical specificity of derivatizing reagents, or chromatographic separation of gas or liquid mixtures. The analytical methods are calibrated by using known standards covering a range of concentration suitable for the test sample. Values are reported as weight of compound per puff or per cigarette. Comparisons are made by reporting actual concentrations or percent reductions caused by selective filtration of the smoke prior to analysis. Each of the methods used to generate data presented here are standard analytical procedures.

TABLE 9

| Carbonyl Compound Reduction | | | | | | | | | | |
|---|---|---|---|---|---|---|---|---|---|---|
| Run | Filter Type | Puff Count | FOR (%) | AAH (%) | ACT (%) | ACR (%) | PRO (%) | CRO (%) | MEK (%) | BUT (%) |
| 1 | A4 | 9.0 | 26 | 51 | 54 | 54 | 57 | 59 | 64 | 61 |
| 2 | A4 | 9.0 | 40 | 48 | 51 | 56 | 56 | 57 | 60 | 56 |
| 3 | A4 | 10.0 | 46 | 56 | 59 | 66 | 64 | 70 | 68 | 65 |
| 4 | A5 | 9.0 | 48 | 48 | 52 | 58 | 57 | 64 | 65 | 61 |
| 5 | A5 | 9.0 | 44 | 44 | 51 | 60 | 54 | 65 | 63 | 59 |
| 6 | A5 | 10.0 | 48 | 51 | 50 | 58 | 56 | 58 | 58 | 55 |
| 7 | A6 | 9.0 | 20 | 33 | 39 | 46 | 41 | 55 | 55 | 45 |
| 8 | A6 | 9.0 | 19 | 40 | 43 | 51 | 47 | 59 | 59 | 49 |
| 9 | B4 | 10.0 | 67 | 81 | 80 | 89 | 88 | 92 | 94 | 91 |
| 10 | B4 | 10.0 | 47 | 58 | 64 | 72 | 71 | 80 | 79 | 75 |
| 11 | B4 | 9.0 | 60 | 76 | 77 | 86 | 85 | 91 | 91 | 87 |
| 12 | B5 | 10.0 | 56 | 74 | 75 | 87 | 86 | 93 | 94 | 88 |
| 13 | B5 | 10.0 | 55 | 74 | 75 | 86 | 86 | 91 | 93 | 88 |
| 14 | B5 | 9.0 | 54 | 76 | 76 | 88 | 87 | 93 | 94 | 88 |
| 15 | B6 | 9.0 | 42 | 79 | 77 | 89 | 87 | 91 | 94 | 86 |
| 16 | B6 | 9.0 | 44 | 85 | 80 | 92 | 91 | 92 | 96 | 88 |
| 17 | B6 | 9.0 | 42 | 82 | 79 | 92 | 90 | 89 | 96 | 93 |

Reduction data is presented for formaldehyde (FOR), acetaldehyde (AAH), acetone (ACT), acrolein (ACR), propionaldhyde (PRO), crotonaldehyde (CRO), methylethylketone (MEK) and butyraldehyde (BUT).

TABLE 10

| | | Volatile Organic Compound Reduction | | | | | | |
|---|---|---|---|---|---|---|---|---|
| Run | Filter Type | Puff Count | BD (%) | ISOP (%) | ACRY (%) | BEN (%) | TOL (%) | STY (%) |
| 1 | A4 | 9.3 | 52 | 58 | 56 | 66 | 67 | 67 |
| 2 | A4 | 9.1 | 47 | 55 | 57 | 66 | 71 | 72 |
| 3 | A5 | 9.2 | 44 | 54 | 53 | 62 | 65 | 62 |
| 4 | A6 | 9.8 | 43 | 53 | 69 | 76 | 81 | 65 |
| 5 | A6 | 9.4 | 42 | 48 | 60 | 70 | 78 | 73 |
| 6 | A6 | 9.1 | 40 | 52 | 65 | 72 | 82 | 81 |
| 7 | B4 | 9.6 | 71 | 80 | 82 | 87 | 88 | 83 |
| 8 | B4 | 9.4 | 66 | 77 | 77 | 84 | 84 | 70 |
| 9 | B5 | 9.1 | 75 | 87 | 91 | 93 | 95 | 94 |
| 10 | B5 | 9.1 | 81 | 90 | 93 | 95 | 95 | 88 |
| 11 | B6 | 8.9 | 88 | 95 | 97 | 98 | 98 | 92 |
| 12 | B6 | 9.5 | 88 | 96 | 98 | 97 | 94 | 79 |
| 13 | B6 | 9.4 | 87 | 95 | 98 | 98 | 97 | 92 |

Data for reduction in level of 1,3 butadiene (BD) is presented together reduction in level of isoprene (ISOP), acrylonitrile (ACRY), benzene (BEN), toluene (TOL) and styrene (STY).

Results:

As shown in Table 4, Type A1 filters, each containing about 40 mg of carbon dust, significantly reduced deliveries of the gas-phase components acetaldehyde, hydrogen cyanide, methanol, and isoprene. The data in Tables 5 through 8 demonstrate that the carbon dust showed fairly consistent activity in reducing the deliveries of all four gas components, at least in the first three puffs. The activity of the carbon dust after these three puffs was limited by its capacity. Specifically, in Type A3 filters, in which about 90 mg of carbon dust was used, a greater reduction in the levels of acetaldehyde and isoprene was observed, compared to the reductions obtained using the Type A1 filters. The data in Tables 5 through 8 demonstrate that each Type A3 filter gave a consistent reduction in the deliveries of gas-phase components until the last puff tested. The data in Tables 9 and 10 show that carbon dust in Types A4, A5, and A6 filters was also effective in removing a wide range of carbonyl compounds and volatile organic compounds.

The data in Tables 5 through 8 indicate that the capacity of each Type A1 filter was exhausted after exposure to the fourth puff of smoke, resulting in rapid breakthrough of gas components thereafter. This breakthrough was avoided in each Type D1 filter, which contained about 20 mg of large granules in the shaped filter plug. The firmness of the plugs was greatly increased in Type D filters, as was the capacity for removing gas-phase components. As shown in Table 4, the reduction in the levels of acetaldehyde and hydrogen cyanide using Type D1 filters was significantly larger than the reduction in these levels using Type A1 filters. Moreover, using Type D2 filters, each of which contained both large granules and APS silica gel in a shaped fiber rod, a greater reduction in the levels of acetaldehyde, methanol, and isoprene was observed, compared to levels obtained using Type A2 filters.

The beneficial effects of including large granules in Types B and C filters can be seen in the data in Tables 5 through 8. Significantly lower levels of acetaldehyde, hydrogen cyanide, and methanol were obtained using these filters, compared to levels obtained using Type A3 filters. Finally, the data in Tables 9 and 10 show that large granules in Types B4, B5, and B6 filters resulted in significantly lower levels of carbonyl compounds and volatile organic compounds compared to levels obtained using Types A4, A5, and A6 filters, respectively.

It should be understood that the above detailed description while indicating preferred embodiments of the invention, are given by way of illustration only, since various changes and modifications within the spirit and scope of the invention will become apparent to those skilled in the art from the detailed description.

Also, as noted above, the size of the fine adsorbent particles impregnated into the micro-cavities of the fibers is preferably in the range of 1–50 microns while the size of the granules incorporated in the filters shown in FIGS. 12B, C and D is 20 to 60 mesh.

What is claimed is:

1. A process of impregnating fine adsorbent particles into the cavities of a shaped fiber comprising the steps of:

continuously conveying a shaped fiber with cavities to a reservoir of fine adsorbent particles;

passing the shaped fiber through the reservoir of fine adsorbent particles to thereby produce relative motion between the fiber and the particles; and additionally creating impact forces between the shaped fiber and the fine adsorbent particles to enhance impregnating the particles into the cavities of the fiber where they retain their particle form and, wherein the reservoir of fine adsorbent particles comprises a reservoir of fine carbon having a particle size in the range of between about 1 to 50 micrometers.

2. A process of impregnating fine adsorbent particles into the cavities of a shaped fiber as in claim 1, wherein the step of additionally creating impact forces between the shaped fiber and the fine adsorbent particles includes vibrating the reservoir.

3. A process of impregnating fine adsorbent particles into the cavities of a shaped fiber as in claim 1, wherein the step of additionally creating impact forces between the shaped fiber and the fine adsorbent particles includes physically forcing the particles into the cavities as the fiber passes through the reservoir.

4. A process of impregnating fine adsorbent particles into the cavities of a shaped fibers as in claim 1, wherein the step of additionally creating impact forces between the shaped fibers and the fine adsorbent particles includes blowing the particles onto the shaped fiber as the fiber passes through the reservoir.

5. A process of impregnating fine adsorbent particles into the cavities of a shaped fiber as in claim 1 further including the step of:

removing any excess particles from the fiber outside the reservoir.

6. A process of impregnating fine adsorbent particles into the cavities of a shaped fiber as in claim 5, wherein the step of removing any excess particles from the fiber outside the reservoir includes directing an air stream onto the fiber from a pressurized or vacuum source.

7. A process of impregnating fine adsorbent particles into the cavities of a shaped fiber as in claim 5, wherein the step of removing any excess particles from the fiber outside the reservoir includes vibrating the fiber.

8. A process of impregnating fine adsorbent particles into the cavities of a shaped fiber as in claim 5 further including the step of:

recycling any excess particles removed from the fiber back to the reservoir.

9. A process of impregnating fine adsorbent particles into the cavities of a shaped fiber as in claim 1 further including the step of:

repeatedly passing the shaped fiber through the reservoir of fine adsorbent particles.

10. A process of impregnating fine adsorbent particles into the cavities of a shaped fiber as in claim 1, wherein the shaped fiber is drawn through the reservoir of fine adsorbent particles at a speed that produces a dwell time in the reservoir of at least 0.6 seconds.

11. A process of impregnating fine adsorbent particles into the cavities of a shaped fiber comprising the steps of:

continuously conveying a shaped fiber with cavities to a reservoir of fine absorbent particles having a particle size in the range of between about 1 to 50 micrometers;

passing the shaped fiber through the reservoir of fine adsorbent particles to thereby produce relative motion between the fiber and the particles; and additionally creating impact forces between the shaped fiber and the fine adsorbent particles to enhance impregnating the particles into the cavities of the fiber where they retain their particle form and, wherein the step of additionally creating impact forces between the shaped fiber and the fine adsorbent particles includes rotating the reservoir.

12. A process of impregnating fine adsorbent particles into the cavities of a shaped fiber comprising the steps of:

continuously conveying a shaped fiber with cavities to a reservoir of fine absorbent particles having a particle size in the range of between about 1 to 50 micrometers;

passing the shaped fiber through the reservoir of fine adsorbent particles to thereby produce relative motion between the fiber and the particles; and additionally creating impact forces between the shaped fiber and the fine adsorbent particles to enhance impregnating the particles into the cavities of the fiber where they retain their particle form and, including the step of collecting the shaped fiber impregnated with the fine adsorbent particles by winding the fiber to form a bundle of fibers.

13. A process of impregnating fine adsorbent particles into the cavities of a shaped fiber as in claim 12 further including the steps of:

flattening the bundle to produce a flattened bundle with opposite end portions; and cutting away the end portions of the flattened bundle whereby the remaining fibers are aligned with one another.

14. A process of impregnating fine adsorbent particles into the cavities of a shaped fiber as in claim 12 further including the step of:

varying the size of the bundle of fibers by controlling the number of turns of the winding wheel.

* * * * *